US005287253A

United States Patent [19]

Blorstad

[11] Patent Number: 5,287,253

[45] Date of Patent: Feb. 15, 1994

[54] COMBINED LIGHT AND FAN ASSEMBLY

[76] Inventor: Kurt T. Blorstad, 5207 Grenock Dr., Lothian, Md. 20711

[21] Appl. No.: 38,826

[22] Filed: Mar. 25, 1993

[51] Int. Cl.[5] ..... F27D 21/02

[52] U.S. Cl. ..... 362/92; 362/96; 362/226; 416/5

[58] Field of Search ..... 362/92, 96, 226, 253, 362/294, 373; 416/5

[56] References Cited

U.S. PATENT DOCUMENTS 1,504,003 8/1924 Trumbull ..... 416/5
2,087,239 7/1937 Brown ..... 362/96
3,305,168 2/1967 Ramniceanu ..... 116/146 R
4,974,126 11/1990 Hwang ..... 362/96

*Primary Examiner*—Stephen F. Husar
*Attorney, Agent, or Firm*—Brady, O'Boyle & Gates

[57] ABSTRACT

A combined light and fan assembly wherein a fan and light are combined into a single component and mounted in the electrical light socket in the interior of a conventional domestic oven so that when the oven is being heated, and the oven light switch is turned on, the light is illuminated, and the fan runs producing a convection current inside the oven, so that the conventional oven is converted into a convection oven.

6 Claims, 1 Drawing Sheet

FIG_1
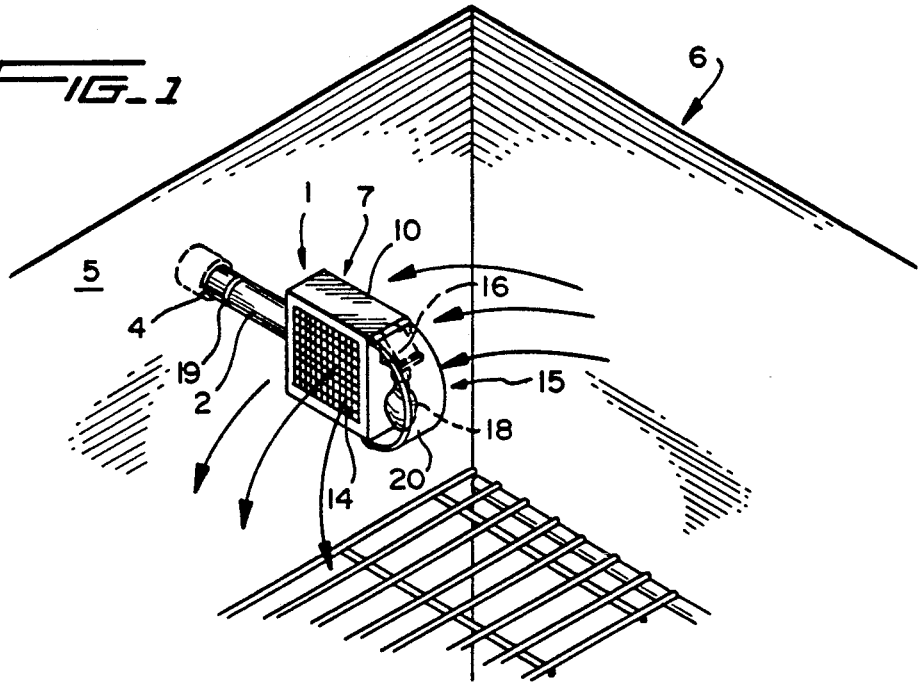
FIG_2
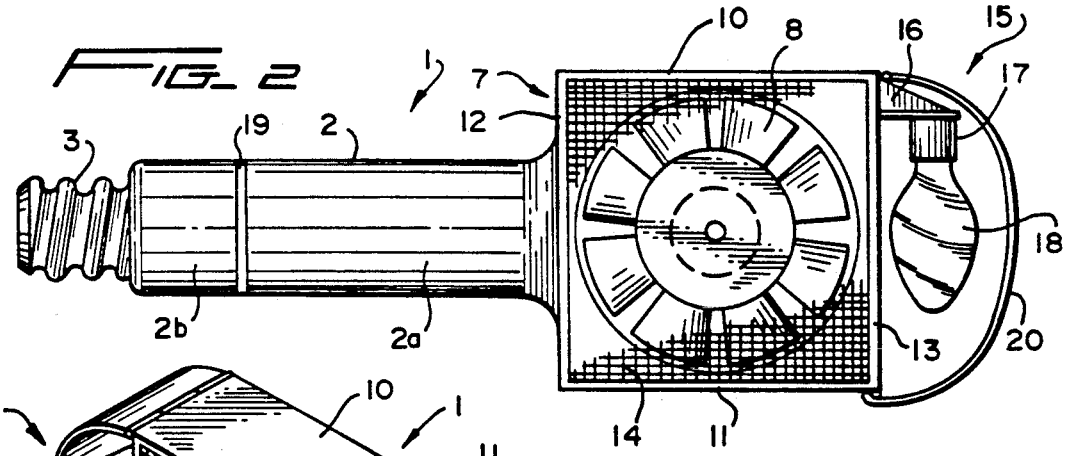
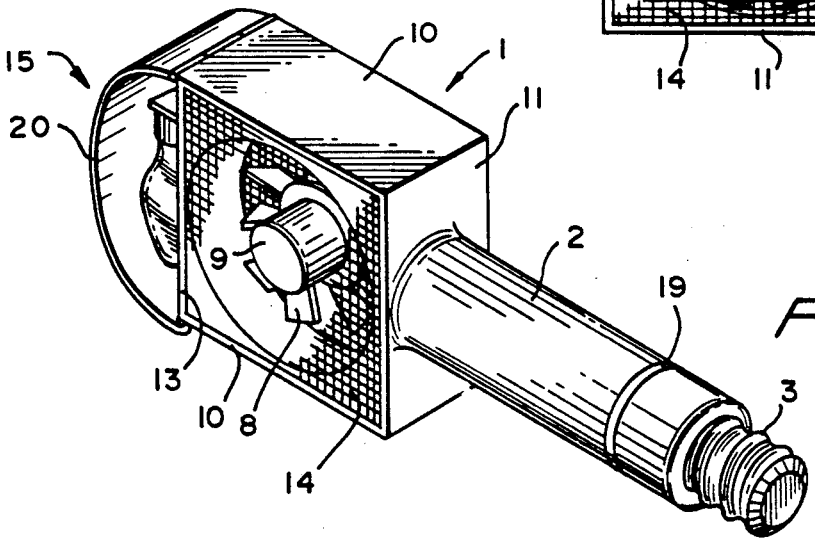
FIG_3

COMBINED LIGHT AND FAN ASSEMBLY

BACKGROUND OF THE INVENTION

Standard domestic ovens are provided with lights which are threaded into an electrical socket on the interior side wall of the oven.

To improve the efficiency of the oven by reducing the cooking time to thereby save energy, fans are installed in the interior of the oven to provide a convection oven wherein the hot air is circulated around the food being cooked. In conventional convection ovens, the fan assembly is built into the oven at the factory, and the light is installed as a separate component.

While these convection ovens have been satisfactory for their intended purpose, after considerable research and experimentation, the combined light and fan assembly of the present invention has been devised wherein a fan and light are combined into a single component and adapted to be threaded into an electrical socket in the interior of a standard domestic oven so that when the oven is on and the oven light switch is turned on, the light is illuminated, and the fan runs producing a convection current inside the oven, whereby a standard oven is converted into a convection oven.

SUMMARY OF THE INVENTION

The combined light and fan assembly of the present invention comprises, essentially, a housing including an elongated neck portion having a threaded electrical plug on one end thereof adapted to be threaded into a standard electrical socket. The opposite end of the neck portion is provided with a cage assembly containing a motor driven fan, and a lamp is mounted on an exterior surface of the cage. By this construction and arrangement, when the combined light and fan assembly is connected to the electrical socket, and the oven light switch is turned on, the lamp is illuminated and the fan is run producing a convection current in the oven, whereby a standard oven is converted into a convection oven.

The neck portion includes a ratchet mechanism so that after the assembly has been threaded into the socket, the fan cage and associated lamp can be positioned in a proper vertical orientation within the oven, and the lamp includes a suitable removable transparent or translucent cover.

BRIEF DESCRIPTION OF THE DRAWINGS

FIG. 1 is a perspective view of the combined light and fan assembly of the present invention mounted in an oven;

FIG. 2 is a side elevational view of the light and fan assembly; and

FIG. 3 is a perspective view of the combined light and fan assembly showing the other side of the assembly from that shown in FIG. 2.

DESCRIPTION OF THE PREFERRED EMBODIMENT

Referring to the drawing, the combined light and fan assembly of the present invention comprises a housing 1 having an elongated neck portion 2 provided with a threaded electrical plug 3 on one end thereof adapted to be threaded into a standard electrical socket 4 provided in the side wall 5 of a standard domestic oven 6. The opposite end of the neck portion is integral with a cage assembly 7 containing a fan 8 driven by an electric motor 9.

The cage assembly 7 comprises a top wall 10, a bottom wall 11 and end walls 12 and 13. The open sides of the cage assembly 7 are covered by a wire grid or mesh 14, whereby air is allowed to flow through the cage assembly 7.

A lamp fixture 15 is mounted on the end wall 13 of the cage assembly 7 and comprises a cantilevered bracket 16 fixed to the cage assembly end wall 13 and having a depending electrical socket 17 into which a light bulb 18 is threaded. A removable cover 19 is detachably connected to the cage end wall 13 for enclosing and protecting the light bulb 18.

In order that the combined light and fan assembly is properly oriented after being threaded into the socket 4, as shown in FIG. 1, the neck portion 2 of the housing is provided with a ratchet mechanism 20 so that the portion **2*a* of the neck and associated cage assembly 7 and lamp fixture 15 can be rotated relative to portion 2*b* of the neck which is fixedly held in the socket 4**.

From the above description it will be appreciated by those skilled in the art that the combined light and fan assembly of the present invention provides a fan and light combined into a single component and adapted to be threaded into an electrical socket in the interior of a standard oven, whereby a standard domestic oven can be converted to an illuminated, convection oven.

While the combined light and fan assembly of the present invention has been described for use in domestic ovens, it can also be employed in other environments where a combined fan and light are desired, such as, a bedroom or bathroom night light.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A combined light and fan assembly comprising, a housing having an elongated neck portion, a threaded electrical plug on one end of the elongated neck portion adapted to be threaded into an electrical socket, a cage assembly on the other end of said elongated neck portion, a motor driven fan mounted in said cage assembly, and a lamp fixture mounted on the exterior of said cage assembly, said motor driven fan and lamp fixture being electrically connected to said electrical plug.

2. A combined light and fan assembly according to claim 1, wherein the cage assembly comprises, a top wall, a bottom wall, and end walls extending between said top and bottom walls, a wire mesh extending between the top, bottom and end walls on each side thereof, whereby air is allowed to flow through the cage assembly.

3. A combined light and fan assembly according to claim 2, wherein said lamp fixture comprises a cantilevered bracket fixed to and extending outwardly from an end wall of the cage assembly, an electrical socket mounted on said bracket, and a light bulb threaded into said socket.

4. A combined light and fan assembly according to claim 3, wherein a removable cover is detachably connected to said end wall for enclosing and protecting said light bulb.

5. A combined light and fan assembly according to claim 1, wherein a ratchet mechanism is mounted in said elongated neck portion to thereby divide the neck portion into a fixed portion and a rotatable portion; the plug being connected to the fixed portion of the neck, and the cage assembly being connected to the rotatable portion of the neck whereby the cage assembly and associated fan and lamp fixture can be oriented to a desired position.

6. A combined light and fan assembly for use in a non-convection-type domestic oven having an electrical socket within the oven electrically connected to the oven light switch comprising, a housing having an elongated neck portion, a threaded electrical plug on one end of the elongated neck portion, said plug being threaded into the oven electrical socket, a cage assembly on the other end of said elongated neck portion, a motor driven fan mounted in said cage assembly, and a lamp fixture mounted on the exterior of said cage assembly, said motor driven fan and lamp fixture being electrically connected to said electrical plug, whereby when the oven is being heated and the oven light switch is turned on, the lamp fixture is illuminated, and the fan is energized to thereby produce a convection hot air current inside the oven, whereby the non-convection-type oven is converted to a convection-type oven.

* * * * *